United States Patent [19]

White

[11] Patent Number: 4,661,072

[45] Date of Patent: Apr. 28, 1987

[54] CHILD'S PROTECTIVE, ENTERTAINMENT OR EDUCATIONAL DEVICE

[76] Inventor: Alyce D. White, 1645 Bedford Square, Rochester, Mich. 48064

[21] Appl. No.: 798,401

[22] Filed: Nov. 15, 1985

[51] Int. Cl.[4] ..... G04B 19/00

[52] U.S. Cl. ..... 434/260

[58] Field of Search ..... 434/260; 446/7; 272/1 C

[56] References Cited

U.S. PATENT DOCUMENTS

| | | | |
|---|---|---|---|
| 1,543,351 | 6/1925 | Webb | 446/369 |
| 2,619,771 | 12/1952 | Jones | 446/369 |
| 2,972,820 | 2/1961 | Cano | 434/260 |
| 2,994,153 | 8/1961 | Zwolinski | 446/7 |
| 3,085,610 | 4/1963 | Vardan | 446/227 |
| 3,204,367 | 9/1965 | Stubbmann | 46/32 |
| 3,784,224 | 1/1974 | Peeler | 280/150 B |
| 3,945,678 | 3/1976 | Neuman | 297/390 |
| 3,975,037 | 8/1976 | Hontschick et al. | 280/733 |
| 4,190,288 | 2/1980 | Korger | 297/488 |
| 4,197,670 | 4/1980 | Cox | 446/363 |
| 4,594,072 | 6/1986 | Cowell | 446/7 X |

*Primary Examiner*—William H. Grieb

[57] ABSTRACT

A device specially adapted to occupy the attention of a child during travel in a vehicle having a passenger seat includes a soft body having at least one child amusement or educational item and intended upper and lower ends, the device also having means at the upper and lower ends for removably and adjustably securing the body in the vehicle in the intended upper-end-up position and in a manner to prevent rotation of the body so that the child can manipulate the item with both hands.

4 Claims, 9 Drawing Figures

CHILD'S PROTECTIVE, ENTERTAINMENT OR EDUCATIONAL DEVICE

FIELD OF THE INVENTION

This invention relates generally to a device to occupy children, and more particularly to such a device that is specially adapted for protection, education and/or amusement of young children as in, but not limited to, travel in an automotive vehicle, for example.

BACKGROUND OF THE INVENTION AND PRIOR ART STATEMENT

It is a general requirement throughout the U.S. that front and rear passenger seat belts be provided in new automotive vehicles, and a number of states require that seat belts be in use during vehicle operation.

Also, many, if not all, states require that young children under certain ages be seated in a special approved separate or auxiliary children's car seat, the latter normally being secured to the vehicle seat by the seat belt, and the child being secured in the children's car seat by special straps or other means provided for that purpose.

It is a fact, however, that travel with young children (up to about four years of age, for example) required to be in a children's car seat is often a problem, not only for the children, but also for the parents. That is, a child buckled in such a seat for even a relatively short period of time, without something to keep the child amused, becomes uncomfortable just from being confined, which, in combination with a child's usual impatience and short attention span, makes the child cranky and irritable.

It is thus apparent that there is a real need for an amusement and/or educational device or means for occupying the attention of and protecting young children during travel in vehicles.

A search conducted for prior art devices that might fulfill the above needs uncovered only the following issued U.S. patents:

A. Webb U.S. Pat. No. 1,543,351—dated June 23, 1925, Jones U.S. Pat. No. 2,619,771—dated Dec. 2, 1927, and Cox U.S. Pat. No. 4,197,670—dated Apr. 15, 1980, which teach various toys having a pouch in which other toys are removably stored.

B. Vardan U.S. Pat. No. 3,085,610—dated Apr. 16, 1963, which teaches a pouch-type toy carrier.

C. Stubbmann U.S. Pat. No. 3,204,367—dated Sept. 7, 1965, which teaches a bracket for attaching a toy that has "a top panel and at least two opposed side flanges" to a child's chair or similar object.

D. Neuman U.S. Pat. No. 3,945,678—dated Mar. 23, 1976, Peeler U.S. Pat. No. 3,784,224—dated Jan. 8, 1974, Hontschik et al U.S. Pat. No. 3,975,037—dated Aug. 17, 1976 and Korger U.S. Pat. No. 4,190,288—dated Feb. 26, 1980 teach children's car seats that include a deceleration impact cushion or bag.

SUMMARY OF THE INVENTION

In addition to safety belts, all passenger vehicles are fitted with sun visors above the windshield, and most vehicles have adjustable headrests on the adjustable front seats, front seat shoulder belt brackets and clothes hanger hooks, which may be employed as part of or in combination with the invention for purposes to be described.

Considering the above background and prior art, a main object of the invention is to provide a protective, entertainment and/or educational device for young children.

Another main object of the invention is to provide a device or means comprising a combination of elements, including elements of a passenger vehicle and other novel elements specially adapted for cooperation therewith, the combination providing protective, amusement and educational means for young children required to be secured in a children's car seat.

A further object of the invention is to provide a children's toy device that includes specific entertainment and educational features, whether or not used in, or in combination with, a passenger vehicle.

A still further object of the invention is to provide such means that may be used in, or in combination with, devices other than a passenger vehicle, such as a baby crib.

Another object of the invention is to provide such a device or means having intended upper and lower ends and means at such ends for securing the same in such position.

A more specific object of the invention is to provide such means comprising a toy body in the form of a human or animal configuration having a head, abdomen, arms and legs, the body comprising a soft cloth or other preferably washable envelope filled with a washable stuffing.

Still another object of the invention is to provide a device having a soft body of any desired form, with adjustable means thereon for attaching the same to another support object, such as the interior of a vehicle.

Other objects of the invention are to provide:

(a) such a device having means at opposite ends thereof for attaching the same to another object.

(b) such a device wherein the attaching means are adjustable straps (c) such a device wherein the straps include quick-releasing fastening means sold under the trademark VELCRO.

(d) such a device adapted to have one end attached to an auxiliary child's car seat and the opposite end attached either to the front seat headrest or to the sun visor, for example, (e) such a device adapted to be stretched and anchored in front of the child so as to enable the child to manipulate the educational or amusement elements thereof with both hands, without having to hold the device, and so that the device body provides a soft impact surface in the event that the child is for some reason thrown forward upon a sudden deceleration caused by braking of the vehicle or an accident.

(f) such a device that can be used as a pillow.

(g) such a device wherein at least one side of the body, and especially the side of the body facing the child when the device is anchored in the vehicle, is formed with educational features, such as, but not limited to, one or more of the following:

(1) a bow tie forming means (2) a shoe lacing means (3) a ZIPPER (a well-known fastening means sold under the trademark ZIPPER) means (4) a button means (5) a VELCRO means (6) a male/female snap fastener means (7) erasable pressure tablet means (8) a music box (h) such a device wherein one side of the body is formed with one or more open top pockets opened and closed by at least one of the button, ZIPPER or other fastening means, the pockets having stored therein the other non-fastening entertainment means, such as a writing tablet, the stored means being detachably secured therein by a tether so as to be removable when washing the body, for example.

(i) such a device wherein the entertainment and educational features are disposed on a base panel that can be attached and detached to or from either side of the body, so as to be able to change the entertainment and educational features to children of various ages, thereby making the device adaptable for use not only by small babies, but also for older children no longer required to be secured in a children's car seat.

These and other objects and advantages of the invention will become more apparent upon consideration of the specification and the appended drawings illustrating various preferred embodiments of the invention for purposes of illustration.

DETAILED DESCRIPTION

Figure 1:
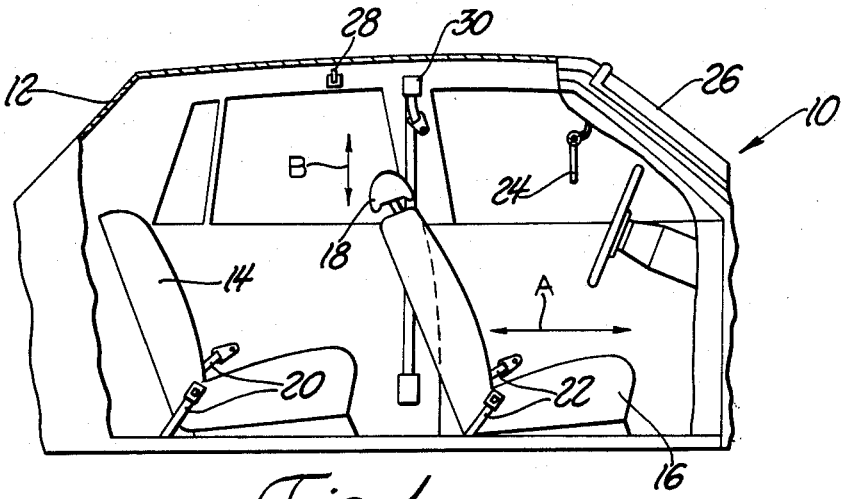
FIG. 1 is a side elevational view of a typical passenger vehicle, with a portion thereof cut away to expose the interior configuration.

In the description that follows, and in the drawings, like or identical elements are identified with the same reference numerals.

Referring now to FIG. 1, a typical passenger vehicle 10 includes a body 12, a rear seat 14, a front seat 16 that is normally adjustable back and forth (as represented by Arrow A) and that includes a vertically adjustable (as represented by Arrow B) headrest 18, fast-release rear and front seat belts 20 and 22 for the driver and each passenger and an adjustable driver and passenger sun visor 24 mounted above the windshield 26 for the driver and front seat passenger. Most passenger vehicles are also fitted with a clothes hanger bracket 28 and a shoulder belt bracket 30.

The structure and operation of the above-mentioned vehicle elements shown in FIG. 1 are so well known that no further description thereof is necessary, except as may be further described below for purposes of describing the invention.

Figure 2:
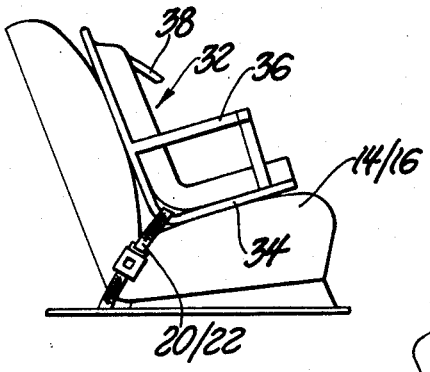
FIG. 2 is a side elevational view of a child's auxiliary car seat secured on a passenger vehicle seat by means of the vehicle seat belts.

An auxiliary child's car seat 32, as shown in FIG. 2, typically includes a main frame 34, an arm rest member 36 at each side of the seat 32 and any suitable shoulder strap or other means represented at 38 for securing the child in the seat 32.

It will be seen from FIGS. 1 and 2 that the child's car seat 32 can be firmly anchored to a rear or front seat 14/16 of the vehicle 10, simply by securing the rear or front seat belt 20/22 about the child's car seat, as over the frame 34, rather than fastening the belt 20/22 around the child.

Obviously, children not required to be fastened in an auxiliary child's car seat can be secured on the rear or front seat 14/16 by a seat belt 20/22, like any passenger, the invention being still usable by the child, as will be described below.

Referring now to FIGS. 3-6, one embodiment of the invention contemplates a protective, educational and/or amusement means or device 40.

Specifically, the device 40 may comprise a teddy bear body 42 having a head/preferably embroidered face 44, an abdomen 46, arms 48 and legs 50. The body 42 may be sewn or otherwise formed from two layers (a front layer 52 and a rear layer 54) of a soft, preferably washable cotton or other material, to provide a flat hollow envelope that is then stuffed with a soft and preferably washable filler material 56, which may be a material sold under the trademark FIBERFILL. Obviously, the body 42 may be made in any color and design, preferably a color and design that are attractive to young children of the age level for which the device 40 is intended.

The body 42 is preferably formed or stuffed in a manner to hold its shape (with the abdomen, head, arms and legs preferably all generally in the same plane), but yet sufficiently soft and pliable so as to not bruise a child's face if the child should be thrown against the body 42 in the case of a vehicle accident, for example. Actually, the body 42 is preferably soft because it often serves as a pillow for a child that has fallen asleep, whether or not in a child's car seat.

Figure 3:
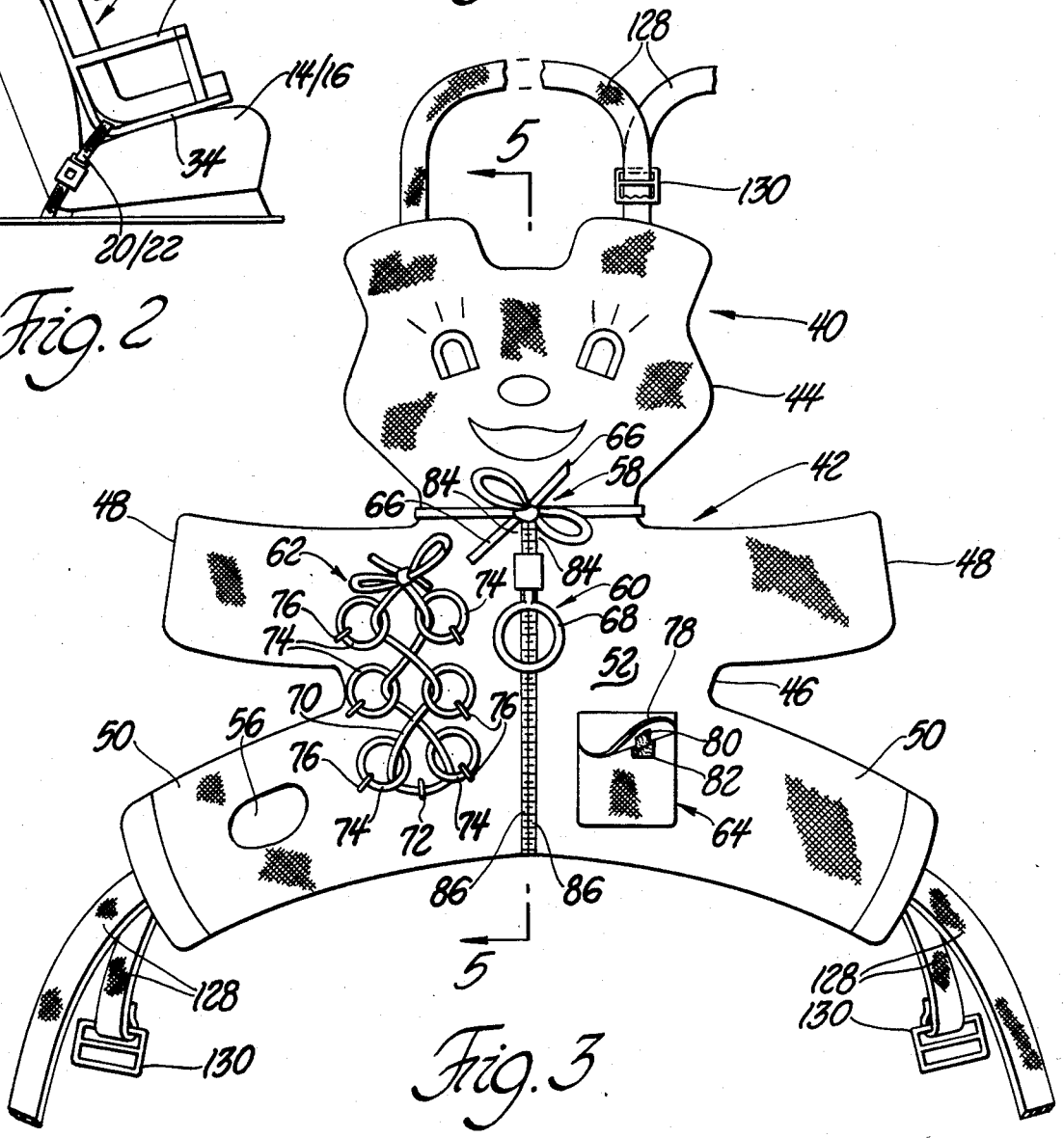
FIG. 3 is a plan view of a device embodying the invention.

In FIG. 3, the teddy bear device 40 is shown as including amusement/educational elements 58, 60, 62 and 64. Bow tie element 58 comprises a pair of ribbon free ends 66 that can be used to practice tying the bow tie 58. Element 60 is a large tooth plastic ZIPPER fastener shown in the fastened (zipped up) condition and easily operated by the plastic ring 68. Element 62 simulates a shoestring means including a ribbon 70 preferably sewn at the middle thereof to the body at 72 to prevent loss thereof by detachment from the body 42, and so that the free ends of the ribbon can be laced through the plastic rings 74 (which are also each sewn to the body 42 at 76) and tied in a bow tie. Element 64 is a pocket with a flap 78 that may be secured by mating adjacent VELCRO elements 80 and 82 provided on the flap 78 and on the pocket 64.

Figure 4:
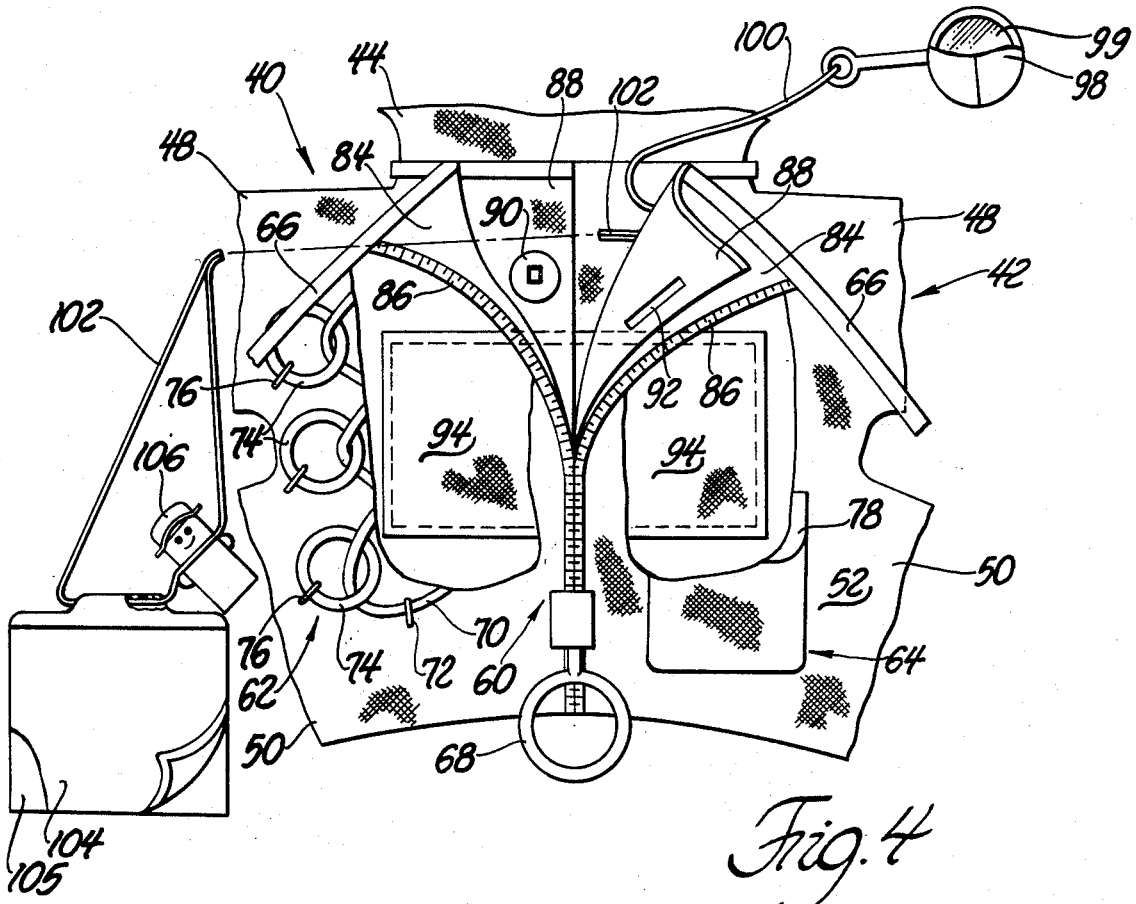
FIG. 4 is an enlarged fragmentary plan view of the device shown in FIG. 3, with portions thereof folded back to illustrate details thereof.
Figure 5:
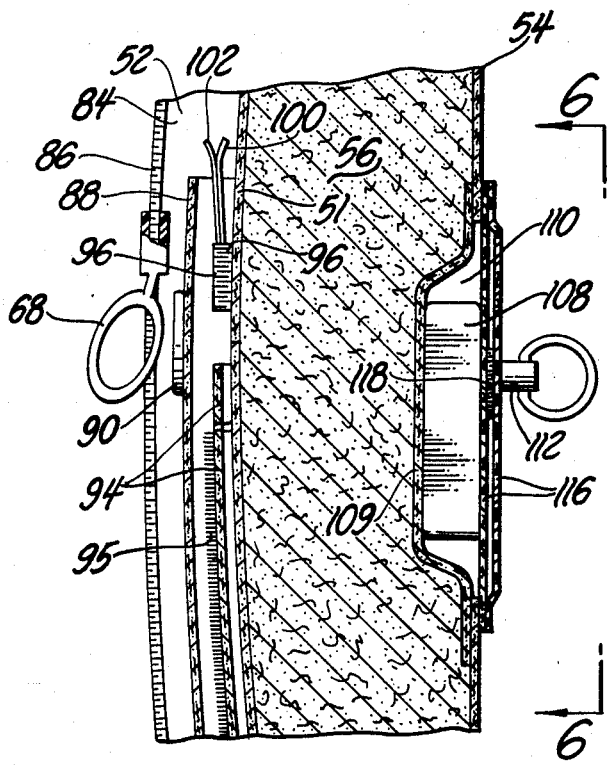
FIG. 5 is an enlarged fragmentary cross-sectional view taken on the plane of line 5—5 of FIG. 3.

As explained above, FIG. 4 is an enlarged fragmentary portion of FIG. 3, with portions thereof cut away, detached and/or folded back to more clearly illustrate the invention. That is, in FIG. 4 the bow tie 58 is untied to show the ribbon free ends 66 extending from the adjacent top corners of the flaps 84 to which the cooperating ZIPPER tracks 86 are secured, the ZIPPER being unzipped and the flaps 84 being folded back to expose the structure thereunder. As seen in FIGS. 4 and 5, when the ZIPPER is zipped up, the flaps 84 are attached at tracks 86 to form an outer pocket on body 42.

FIGS. 4 and 5 also disclose a cloth or other layer under flaps 84, comprising a second set of flaps 88 having button 90/button hole 92 means for securing the same. When flaps 88 are buttoned, they form a second pocket under the outer pocket formed by flaps 84. FIGS. 4 and 5 further disclose a third layer 94 overlaid by the outer pockets formed by flaps 84 and 88 and comprising a patch pocket open at the top thereof.

Any desired releasable attaching means, such as VELCRO means 96 may be provided in a pocket on body 42, and a toy such as a baby rattle 98 is secured to the body 42 by a tether 100 attached to one of the VELCRO elements 96. A second tether 102 may be employed to attach to body 42 a small well-known multilayer tablet 104 of the type that is sold under the trademark MAGIC SLATE and can be erased by separating the layers. The marker for the tablet can be a squeak or other plastic toy 106 that is also secured by tether 102 and serves a dual toy/marker purpose, free of the danger of the usual pencil-like pointed marker. A mirror 99 may replace rattle 98.

It will be understood from the cross-sectional view of FIG. 5 that the body 42 can be made with a plurality of layers providing a plurality of overlaid open top pockets, which may be formed as adjacent flaps that can be secured to each other by ZIPPER, button or other means and in which toys such as the rattle 98 and tablet means 104 shown in FIG. 4 are stored when not in use. It is also apparent that the various pocket layers may be formed on body 42 in any desired manner. That is, the inner surface of the inner pocket may be the front layer 52 of the stuffed envelope, the front layer of the head may be separate from the front layer of the abdomen, or the pockets may be overlaid separate patches.

Figure 6:
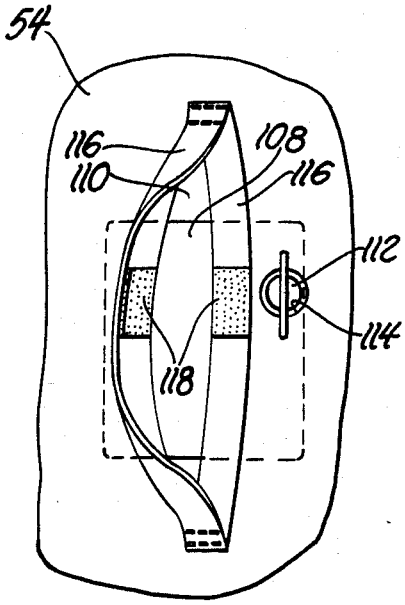
FIG. 6 is a fragmentary rear plan view taken at line 6—6 of FIG. 5.

FIG. 6 also illustrates a modification of device 40 having a music box 108 stored in a pocket cavity 110 formed in any desired manner. As is well known, the threaded music box winder 112, which extends through an opening 114 in the layer 54, is removable by turning the same counterclockwise, as opposed to winding the music box by turning the winder 112 clockwise, so that the music box 108 can be removed from the toy for washing the body 42. The pocket closure flaps 116 can be secured by VELCRO means 118, as shown in FIGS. 5 and 6.

Figure 7:
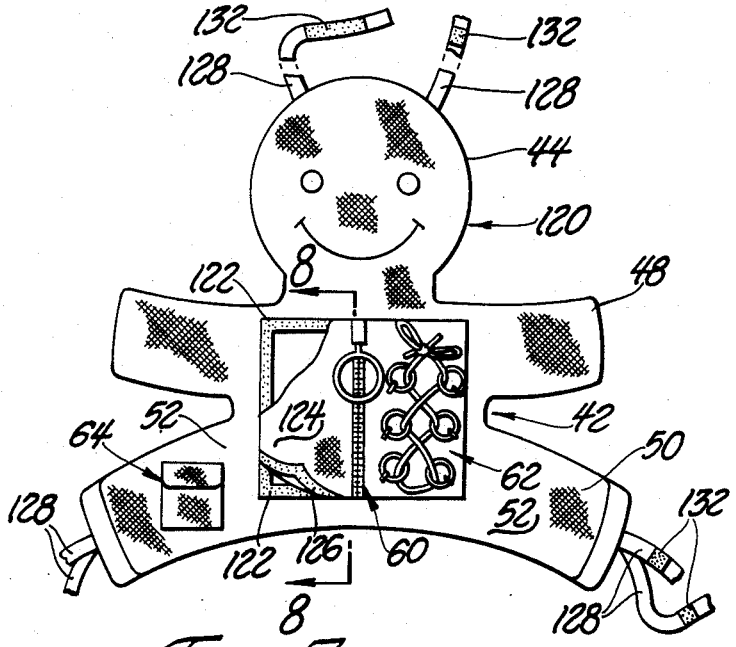
FIG. 7 is a plan view, similar to FIG. 3, of a device emobodying a modification of the invention.
Figure 8:
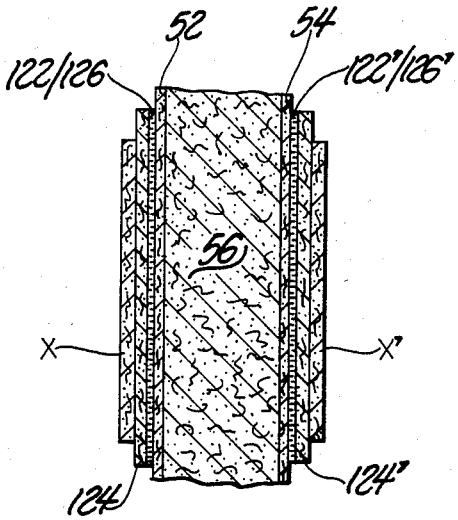
FIG. 8 is an enlarged cross-sectional view, taken on the plane of line 8—8 of FIG. 7, further illustrating the modification of FIG. 7.

FIG. 7 and FIG. 8, which is an enlarged fragmentary sectional view through FIG. 7, illustrate a modified device 120, with a smiley face, having means to specifically adapt a single device 120 to amusement/education of children of different age levels.

In the modification shown in FIG. 7, the outer front surface 52 may have secured thereto quick release attaching means such as a VELCRO element 122 of any desired size and configuration, such as a square. A removable panel 124 having a mating square VELCRO element 126 for attachment cooperation with VELCRO element 122 is thus attachable to the body 42. Obviously, VELCRO of different configuration, or other attaching means may be employed.

Each device 120 may include or have available for use therewith a plurality of panels 124, each panel including amusement/educational means intended for children of a particular different age level. For example, one panel 124 may be formed with the multiple-pocket shoe lace means 62, ZIPPER means 60 and button means 90/92 of the device of FIGS. 3–5. Another substitute panel 124 may have, as a part thereof, pockets with more complex fastening means and/or containing toys or games of greater skill level (for higher age levels), such as playing cards, mathematics cue cards, mechanical puzzles and comic books. Still another substitute panel 124 may comprise simply a furry surface on which the child can rest his head during a nap, like furry surface 95 in FIG. 5.

FIG. 8 is a schematic illustration of a modified device 120 such as that referred to in the above description of FIG. 7. That is, an envelope comprising a front layer 52 and a rear layer 54 is filled with material 56. The panel 124 is secured to the layer 52 by means of the VELCRO means 122/126, and it includes lower age level amusement/educational means represented by element X. A substitute panel 124' is secured to the opposite outer layer 54 by VELCRO means 122'/126', and it includes higher age level amusement/educational means represented by element X'.

As stated above, any particular device 120 may have available for use therewith any desired number of panels 124, even a plurality of panels 124 for the same age level, but with different amusement/educational elements. Also, as stated, the opposite-side colors and configurations of devices 40 and/or 120 may be different, and interchangeable.

That is, it is apparent that a device 40 or 120 embodying the invention may be made in any desired configuration, educational level, etc., and that, by provision of faces and/or removable panels (as shown in FIG. 8) on both sides thereof, the utility of the device can be increased substantially.

Referring again to FIG. 3, device 40 is formed with strap 128 and buckle 130 means at the head 44 and both legs 59 thereof for securing device 40, in a substantially vertical, head-end-up position, in front of the child. In the device 120 of FIG. 7, the straps 128 are shown as including quick release VELCRO elements 132, rather than, or in addition to, buckles 130.

Figure 9:
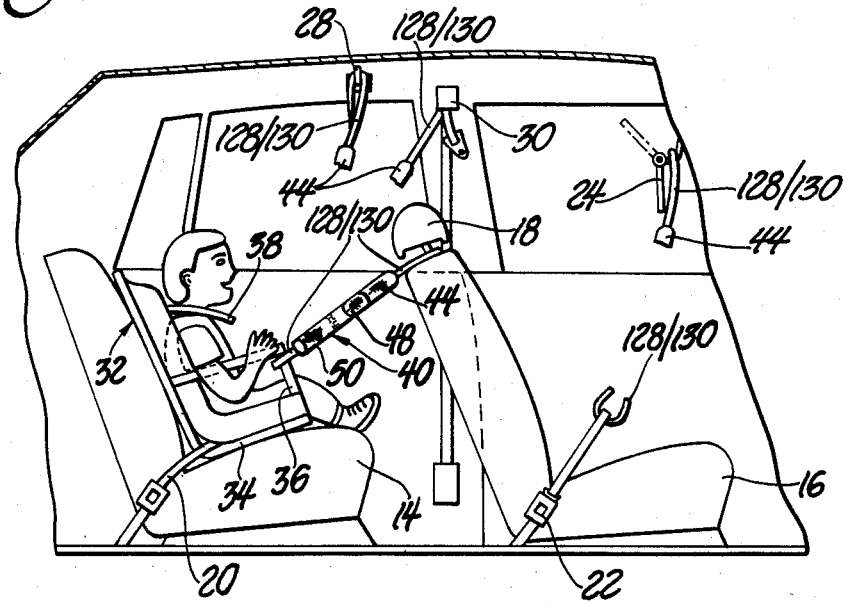
FIG. 9 is a view similar to the view of FIG. 1, illustrating use of the invention.

FIG. 9 illustrates typical use of means such as devices 40 and 120 in a passenger vehicle 10 having the elements shown in FIG. 1, with a child secured in a child's car seat 32 attached to the vehicle rear seat 14. FIG. 9 also illustrates use of a device 40 or 120 at the vehicle front seat 16, without a child's car seat 32.

As explained above, the lower adjustable straps attached to legs 50 are secured to any convenient portion of the child's car seat frame, such as the arm rests 36, while the upper adjustable strap 48 attached to head 44 is secured to the front seat headrest 18. If the vehicle 10 has no headrest 18, then the upper strap 128 can be secured to the chest belt bracket 30 or to the clothes hook 28. In fact, it has been found that a device 40 or 120 can at times be attached to bracket 30 or hook 28 solely for the purpose of blocking the sun from the child.

Of course, if the child is seated in the vehicle front seat 16, then the strap 128 attached to head 44 can be connected to the sun visor 24. If no child's car seat is used, then the lower adjustable straps 128 attached to device legs 50 can be connected to the vehicle seat belts 20 or 22, as shown at the front seat of FIG. 9.

Where a special infant cradle (not shown) for children weighing less than 18 pounds is reportedly required by law to be secured to the rear or the front vehicle seat in a position so that the child rides backwards, the device 40 or 120 is merely positioned against the vehicle seat back, with the straps 128 between the device and the seat back so that they do not fall on the infant.

It has been found that preferred dimensions for a device 40 or 120 is about 21 inches long and 21 inches wide, which provides adequate area for educational elements, and about 3 inches thick, which provides adequate energy absorption. All materials are non-toxic, and all parts are too large to swallow.

Most of the configurations of the various devices are human or animal figures recognized by children so that the device must be secured in a vertical position with the head-end-up. Also, the device, being soft, must be mounted relatively rigidly and flat so that the child can operate the educational devices with both hands, without having to use a hand to steady body 42. That is, the adjustable straps 128 arranged in a generally triangular position with respect to each other extend from spaced attachment points on the head 44 and from a single point on each of the substantially spaced legs 50, to prevent rotation of body 42 on the desired flat position facing the child.

In FIG. 4, a portion of rattle 98 is broken away to illustrate a mirror 99, in which the mirror element may be non-breakable. Also, the broken away portion of tablet 104 represents other educational or amusement elements, such as a baby teething device, a deck of playing cards, various cue cards or the like. In FIG. 5, the pocket 110 is formed by an inner patch 109 attached to layer 54, as by sewing.

It is apparent, from the above disclosure, that the invention provides the intended objects and advantages, and that the device 40 or 120 has utility as a child amusement and educational means wherever it may be used. However, in a vehicle, it also provides child protection and other functions, such as a pillow and a sun guard.

While various preferred embodiments of the invention have been shown and described for purposes of illustration, other modifications are possible within the scope of the invention, and no limitations are intended except as recited in the appended claims.

What I claim as my invention is:

1. An amusement and/or educational device specially adapted to occupy the attention of a child at any time, but particularly during travel in a vehicle having at least one passenger seat, said device comprising a body having intended upper and lower ends and means at each of said upper and lower ends adapted for securing said body in the intended upper-end-up position, said body being formed with a plurality of overlaid adjacent inner and outer pockets open at the top thereof facing said upper end, the outer layer of at least said outer pocket being formed with a vertical slit to provide opposing flaps, said flaps having button, ZIPPER or other amusement or educational fastening means for permitting said flaps to be separated along said slit and folded back to expose said adjacent inner pocket.

2. The device of claim 1, wherein said outer pocket of said body is formed as a separate detachable panel, said panel being secured to said body by means permitting removal of said panel from said body and substituting therefor another separate panel of different configuration or different amusement or educational age level.

3. An amusement and/or educational device specially adapted to occupy the attention of a child at any time, but particularly during travel in a vehicle having at least one passenger seat, said device comprising a body having intended upper and lower ends and means at each of said upper and lower ends adapted for securing said body in the intended upper-end-up position, said body being formed with a plurality of overlaid adjacent inner and outer pockets open at the top thereof facing said upper end, the outer layer of at least said outer pocket being formed with a vertical slit to provide opposing flaps, said flaps having button, ZIPPER or other amusement or educational fastening means for permitting said flaps to be separated along said slit and folded back to expose said adjacent inner pocket, said pocket adjacent said outer pocket being likewise formed with a vertical slit to provide opposing flaps, said flaps having fastening means different from said fastening means of said outer pocket.

4. A device specially adapted to occupy the attention of a child during travel in an automobile, said device comprising the combination of (A) a body formed with relatively flat opposite sides and (B) a plurality of panels adapted to be interchangeably secured on at least one of said sides of said body, said body having means for removably and adjustably anchoring the same between available objects in the interior of the automobiles in a manner to provide a resistance to rotation of said body from its anchored position, and said body having means for detachably securing any of said panels to said sides of said body, one or more of said plurality of panels being formed to provide thereon at least one pocket having an open end and a slit forming opposed flaps at said open end, said opposed flaps being connected together by button, ZIPPER or other means permitting said flaps to be disconnected and folded back to expose the interior of said pocket, each of said pockets of said plurality of panels having one or more amusement or educational items therein, said items of each panel being suited for a different child age level, whereby the utility of said device comprising a single body and a plurality of panels is increased by the fact that it can accommodate a child at, or children of, different ages by interchanging said panels, said panels having means cooperating with said means on said body for removably securing said panels to said body.

* * * * *